US012486129B2

(12) United States Patent
Mizuguchi

(10) Patent No.: US 12,486,129 B2
(45) Date of Patent: Dec. 2, 2025

(54) SHEET FEEDING DEVICE THAT SEQUENTIALLY DRAWS OUT AND FEEDS SHEETS FROM SHEET TRAY, AND IMAGE FORMING APPARATUS INCLUDING SAME

(71) Applicant: KYOCERA Document Solutions Inc., Osaka (JP)

(72) Inventor: Keisuke Mizuguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/662,082

(22) Filed: May 13, 2024

(65) Prior Publication Data

US 2024/0383700 A1 Nov. 21, 2024

(30) Foreign Application Priority Data

May 16, 2023 (JP) ..... 2023-081113

(51) Int. Cl.
*B65H 3/06* (2006.01)
*B65H 3/52* (2006.01)

(52) U.S. Cl.
CPC ..... *B65H 3/0607* (2013.01); *B65H 3/5261* (2013.01); *B65H 2402/31* (2013.01); *B65H 2404/1521* (2013.01); *B65H 2801/06* (2013.01)

(58) Field of Classification Search
CPC .. B65H 3/0607; B65H 3/0684; B65H 3/5261; B65H 2402/31; B65H 2403/51; B65H 2404/142; B65H 2404/1421; B65H 2404/144
See application file for complete search history.

(56) References Cited

U.S. PATENT DOCUMENTS 5,725,208 A * 3/1998 Miyauchi ..... B65H 3/5261 271/272
5,997,198 A * 12/1999 Murayama ..... B65H 3/0661 271/121
7,607,656 B2 * 10/2009 Yoshida ..... B65H 3/5261 271/124
11,649,125 B2 * 5/2023 Oshiro ..... B65H 3/5207 271/273
2002/0175462 A1 11/2002 Sonoda

FOREIGN PATENT DOCUMENTS

JP 2003026349 A 1/2003

* cited by examiner

*Primary Examiner* — Michael Mccullough
(74) *Attorney, Agent, or Firm* — IP Business Solutions, LLC.

(57) ABSTRACT

In a sheet feeding device, when the rotating member is set to a prespecified rotation angle, a first follower makes contact with a concave portion formed on a circumferential surface of a first cam, thereby retaining a first support member at a standby position, and a second follower makes contact with a concave portion formed on a circumferential surface of a second cam, thereby retaining a second support member at a standby position. When the rotating member is made to rotate, the first follower is disengaged from the concave portion of first cam, thereby making the first support member pivot about is shaft, and bringing the pickup roller into contact with a recording sheet, and the second follower is disengaged from the concave portion of the second cam, thereby making the second support member pivot about its shaft, and bringing the retard roller into contact with the feed roller.

5 Claims, 13 Drawing Sheets

SHEET FEEDING DEVICE THAT SEQUENTIALLY DRAWS OUT AND FEEDS SHEETS FROM SHEET TRAY, AND IMAGE FORMING APPARATUS INCLUDING SAME

INCORPORATION BY REFERENCE

This application claims priority to Japanese Patent Application No. 2023-081113 filed on May 16, 2023, the entire contents of which are incorporated by reference herein.

BACKGROUND

The present disclosure relates to a sheet feeding device, in which a plurality of sheets are placed on a sheet tray, and configured to sequentially draw out and feed the sheets from the sheet tray, and an image forming apparatus including such sheet feeding device. In particular, the present disclosure relates to a technique to draw out the sheet from the sheet tray.

The image forming apparatus includes a sheet feeding device that supplies recording sheets, and an image forming device that forms an image on the recording sheet supplied. Some existing sheet feeding devices are configured to rotate a pickup roller pressed against the uppermost one of the recording sheets on the sheet feeding tray, thereby drawing out the uppermost recording sheet, and transport the recording sheet thus drawn out with a feed roller. At the same time, a retard roller is pressed against the feed roller, to prevent multifeed of the recording sheets being transported by the feed roller.

In addition, some other existing sheet feeding devices include a feed roller that sequentially draws out a plurality of sheet materials stacked in a sheet tray, a return lever that regulates the position of the leading edge of each of the sheet materials, an ASF control gear associated with the feed roller, and a lever control cam provided on the ASF control gear. In this case, the ASF control gear is made to rotate, interlocked with the feed roller, together with the lever control cam. The lever control cam switches the rotation angle of the return lever, so as to set the return lever at a first position, a second position, or a third position. In such sheet feeding device, the return lever set at the first position prevents, when the sheet materials are placed, the leading edge of the sheet material from accidentally intruding into a deep region of the feeding device. The return lever set at the second position serves to return the leading edge of the sheet materials additionally placed, to a predetermined reference position for the leading edge of the sheet material. At the third position, the return lever is retracted so as not to obstruct the separation or transport of the sheet materials.

SUMMARY

The disclosure proposes further improvement of the foregoing techniques.

In an aspect, the disclosure provides a sheet feeding device including a sheet tray, a pickup roller, a feed roller, a first support member, a retard roller, a second support member, a drive device, a rotating member, a first cam and a second cam, a first follower, and a second follower. On the sheet tray, a plurality of sheets are placed. The pickup roller draws out the sheets from the sheet tray, one by one. The feed roller transports the sheet drawn out by the pickup roller. The first support member supports the pickup roller, and the feed roller at a position downstream of the pickup roller in a drawn out direction of the sheet, and is configured to pivot about a first shaft rotatably supporting the feed roller. The retard roller is made to contact or moved away from the feed roller. The second support member supports the retard roller, and is configured to pivot about a second shaft spaced from a shaft of the retard roller. The drive device rotates the first shaft of the feed roller. The rotating member is made to rotate about a shaft parallel to the first shaft, by a rotational driving force transmitted from the first shaft. The first cam and the second cam are provided on the rotating member, and rotate interlocked with the rotating member. The first follower is provided on the first support member, and configured to make the first support member pivot about the first shaft, by making slide-contact with a circumferential surface of the first cam. The second follower is provided on the second support member, and configured to make the second support member pivot about the second shaft, by making slide-contact with a circumferential surface of the second cam. When the rotating member is set to a prespecified rotation angle, the first follower makes contact with a concave portion formed on the circumferential surface of the first cam, thereby retaining the first support member at a standby position, and the second follower makes contact with a concave portion formed on the circumferential surface of the second cam, thereby retaining the second support member at a standby position.

In another aspect, the disclosure provides an image forming apparatus including the foregoing sheet feeding device, and an image forming device that forms an image on a recording sheet delivered from the sheet feeding device.

DETAILED DESCRIPTION

Hereafter, an embodiment of the disclosure will be described, with reference to the drawings. The terms stating a rotating direction, a left-right direction, and an up-down direction, which may appear in the following description, are indicating an exemplary direction in the corresponding drawing, unless otherwise specifically noted.

Figure 1:
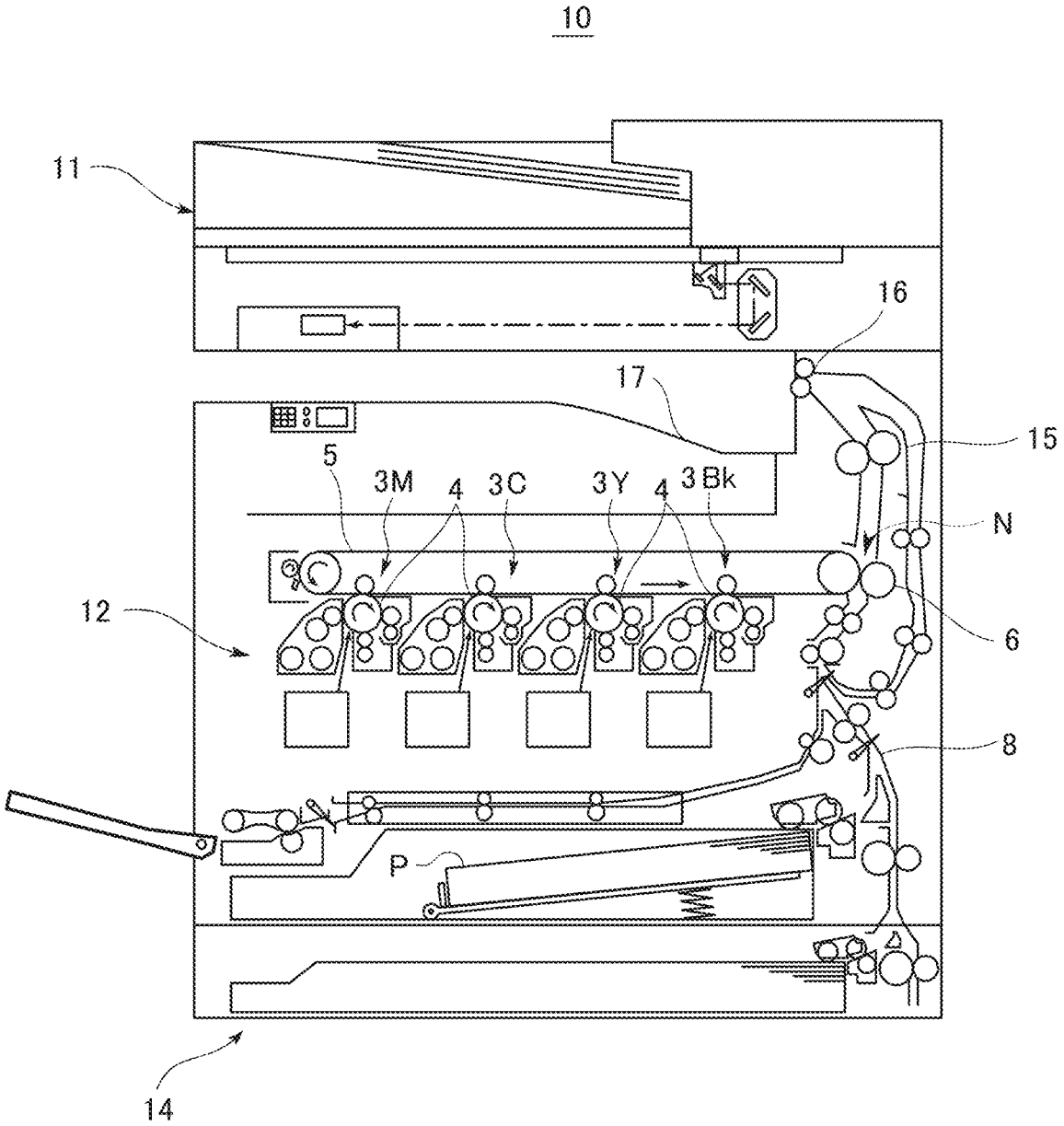
FIG. 1 is a cross-sectional view showing an image forming apparatus, incorporated with a sheet feeding device according to an embodiment of the disclosure.

FIG. 1 is a cross-sectional view showing an image forming apparatus, incorporated with a sheet feeding device according to the embodiment of the disclosure. As shown in FIG. 1, the image forming apparatus 10 according to the embodiment includes an image reading device 11 and an image forming device 12.

The image reading device 11 includes an image sensor, such as a CCD sensor or a contact image sensor. An analog output from the image sensor is converted into a digital signal, and image data representing the image of the document is generated.

The image forming device 12 serves to print the image represented by the image data, on a recording sheet, and includes an image forming unit 3M for magenta, an image forming unit 3C for cyan, an image forming unit 3Y for yellow, and an image forming unit 3Bk for black. In each of the image forming units 3M, 3C, 3Y, and 3Bk, the surface of a photoconductor drum 4 is uniformly charged and exposed, to there by form an electrostatic latent image on the surface of the photoconductor drum 4, and then the electrostatic latent image on the surface of the photoconductor drum 4 is developed into a toner image, which is transferred to an intermediate transfer belt 5. As result, a colored toner image is formed on the intermediate transfer belt 5. The colored toner image is transferred, as secondary transfer, to the recording sheet P transported from the sheet feeding device 20 along a transport route 8, at a nip region N between the intermediate transfer belt 5 and a secondary transfer roller 6.

Thereafter, a fixing device 15 heats and presses the recording sheet P, to fix the toner image onto the recording sheet P, by thermal compression, and then the recording sheet P is delivered to an output tray 17, via a delivery roller 16.

Figure 2A:
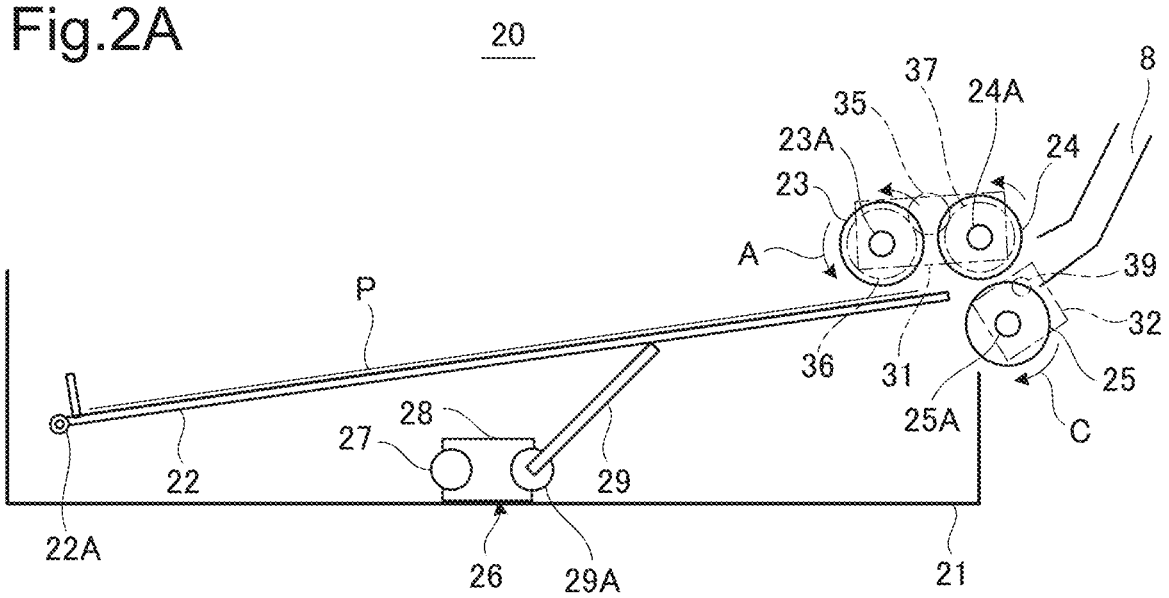
FIG. 2A and FIG. 2B are schematic cross-sectional views of the sheet feeding device according to the embodiment, for explaining working of a pickup roller, a feed roller, and a retard roller.
Figure 2B:
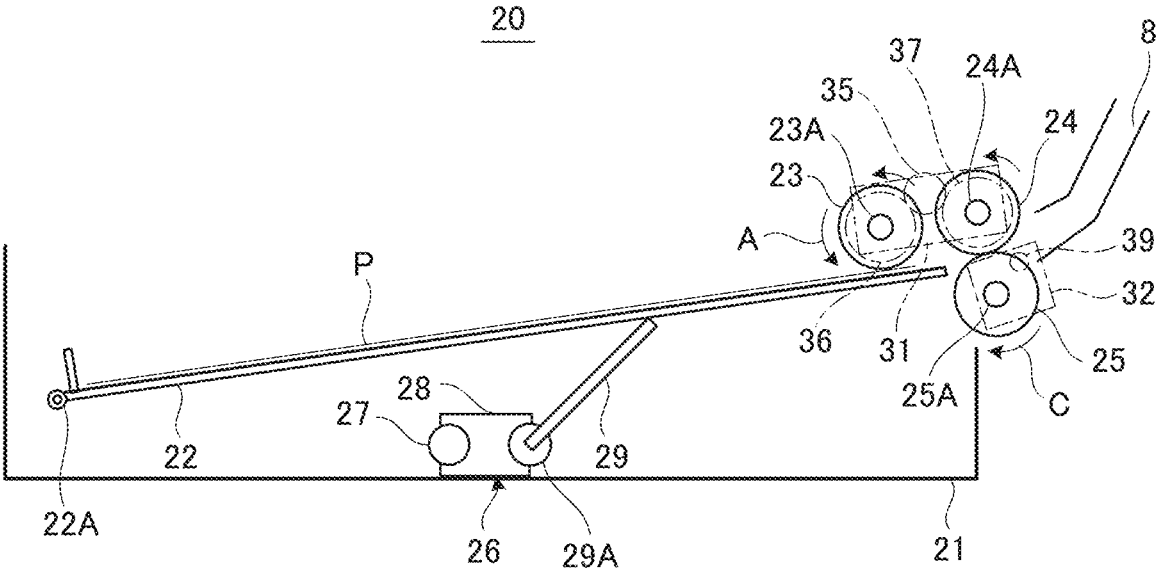

FIG. 2A and FIG. 2B are schematic cross-sectional views of the sheet feeding device 20 according to this embodiment, seen from the lateral direction. As shown in FIGS. 2A and 2B, a sheet feeding tray 22 on which a plurality of recording sheets P are placed, and an elevation device 26 that moves up and down the forward end portion of the sheet feeding tray 22, are provided on a sheet cassette 21 of the sheet feeding device 20.

On the outer side of an end portion of the sheet cassette 21, a pickup roller 23 that draws out the recording sheet P from the sheet feeding tray 22, a feed roller 24 that transports the recording sheet P, and a retard roller 25 located in contact with the lower circumferential surface of the feed roller 24, are provided.

The rear end portion of the sheet feeding tray 22 is rotatably supported by a shaft 22A, so that the forward end portion of the sheet feeding tray 22 can be moved up and down, by the elevation device 26. The elevation device 26 includes an elevation motor 27, a gear unit 28, and an elevation arm 29. When the elevation motor 27 is driven to rotate, the rotation is transmitted to the elevation arm 29 via the gear unit 28, so that the elevation arm 29 is made to pivot about a shaft 29A.

When the elevation arm 29 is made to pivot counterclockwise about the shaft 29A, the sheet feeding tray 22 is elevated by the distal end portion of the elevation arm 29, such that the sheet feeding tray 22 is made to pivot counterclockwise about the shaft 22A and the forward end portion of the sheet feeding tray 22 is elevated to a position closer to the pickup roller 23.

On the contrary, when the elevation arm 29 is made to pivot clockwise about the shaft 29A, the sheet feeding tray 22 pivots clockwise about the shaft 22A, because of the self-weight, following the distal end portion of the elevation arm 29, and the forward end portion of the sheet feeding tray 22 moves downward. Therefore, the sheet feeding tray 22 moves away from the pickup roller 23, thereby enabling a plurality of recording sheets P to be placed on the sheet feeding tray 22.

A shaft 23A of the pickup roller 23 and a shaft 24A (exemplifying the first shaft in the disclosure) of the feed roller 24 are rotatably supported by a first support member 31. In addition, a non-illustrated shaft of a gear 35 is also rotatably supported by the first support member 31. A gear 36 is fixed to the shaft 23A of the pickup roller 23, a gear 37 is fixed to the shaft 24A of the feed roller 24, and the gear 35 is meshed with the gears 36 and 37. When the shaft 24A of the feed roller 24 is driven to rotate counterclockwise, the feed roller 24 and the gear 37 are made to rotate counterclockwise, and then the rotation of the gear 37 is transmitted to the gear 36 via the gear 35, so that the gear 36 and the pickup roller 23 are made to rotate counterclockwise, like the feed roller 24.

The first support member 31 is pivotably supported by the shaft 23A of the pickup roller 23, and biased in a direction of arrow A, by a non-illustrated first biasing member.

A shaft 25A of the retard roller 25 is rotatably supported by the support member 32. The second support member 32 is pivotably supported by a shaft 39 (exemplifying the second shaft in the disclosure), spaced from the shaft 25A of the retard roller 25, and biased in the direction of arrow C, by a non-illustrated second biasing member.

Referring to FIG. 2A, when the first support member 31 is made to pivot about the shaft 24A in the direction opposite to arrow A, against the biasing force of the first biasing member, the pickup roller 23 is moved away from the uppermost one of the recording sheets P on the sheet feeding tray 22. When, at the same time, the second support member 32 is made to pivot about the shaft 39 in the direction opposite to arrow C, against the biasing force of the second biasing member, the retard roller 25 is moved away from the feed roller 24. In this state, the recording sheet P is kept from being drawn out from the sheet feeding tray 22.

Referring to FIG. 2B, when the first support member 31 is made to pivot about the shaft 24A in the direction of arrow A, by the biasing force of the first biasing member, the pickup roller 23 is also biased in the direction of arrow A about the shaft 24A, thus to be brought into pressure-contact with the uppermost one of the recording sheets P on the sheet feeding tray 22. When, at the same time, the second support member 32 is made to pivot about the shaft 39 in the direction of arrow C, by the biasing force of the second biasing member, the retard roller 25 is also biased in the direction of arrow C about the shaft 39, thus to be pressed against the feed roller 24.

When the pickup roller 23 and the feed roller 24 are made to rotate counterclockwise, with the pickup roller 23 in pressure-contact with the uppermost one of the recording sheets P on the sheet feeding tray 22, and the retard roller 25 pressed against the feed roller 24, as shown in FIG. 2B, the uppermost one of the recording sheets P on the sheet feeding tray 22 is drawn out by the pickup roller 23, and the recording sheet P thus drawn out is transported through between the feed roller 24 and the retard roller 25. The retard roller 25 serves to prevent multifeed of the recording sheets being transported by the feed roller 24.

Hereunder, the configuration and working of the pickup roller 23, the feed roller 24, the retard roller 25, and the related components in the sheet feeding device 20 according to this embodiment, will be described in detail.

In the sheet feeding device 20, the pickup roller 23 is to be brought into pressure-contact with, or moved away from the uppermost one of the recording sheets P on the sheet feeding tray 22, and the retard roller 25 is to be pressed against or moved away from the feed roller 24. Therefore, a mechanism for managing the movement of the pickup roller 23 and the retard roller 25, illustrated in FIG. 3 to FIGS. 11A to 11C, has been conceived, to reduce the number of parts and the size of the apparatus.

Figure 3:
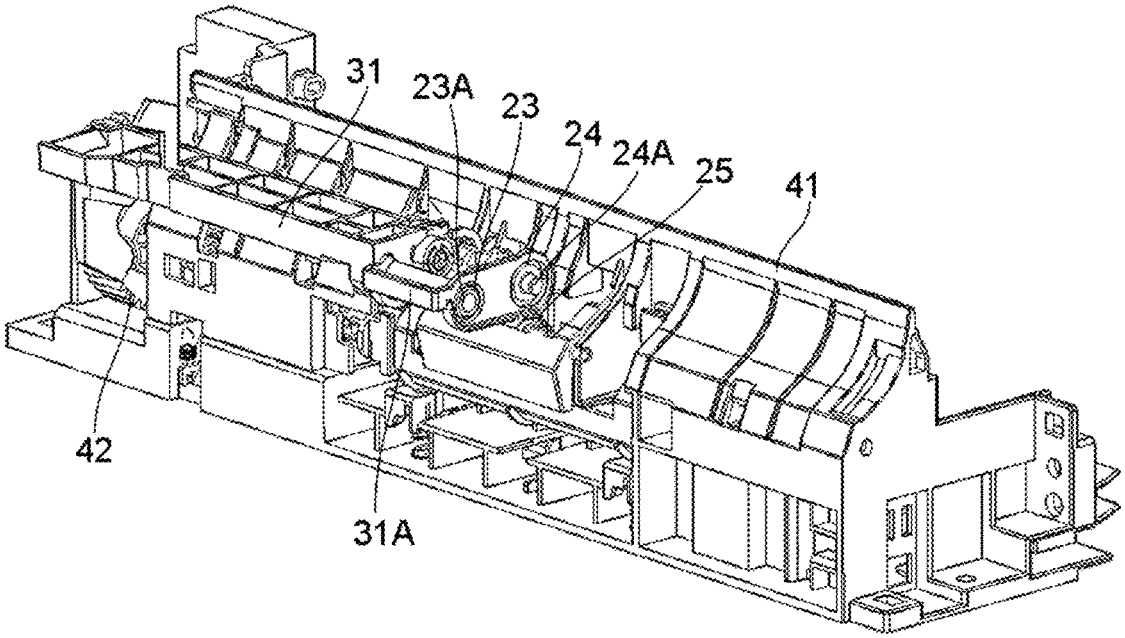
FIG. 3 is a perspective view showing the pickup roller, the feed roller, and the retard roller, seen from the side of a sheet cassette.

FIG. 3 is a perspective view showing the pickup roller 23, the feed roller 24, and the retard roller 25, seen from the side of the sheet cassette 21 (not shown in FIG. 3). As shown in FIG. 3, the pickup roller 23, the feed roller 24, and the retard roller 25 are located at positions corresponding to the central portion of the recording sheet P in the width direction. The shaft 23A of the pickup roller 23 and the shaft 24A of the feed roller 24 are rotatably supported by the first support member 31. The shaft 24A is supported by a frame 41 of the sheet feeding device 20, and supports the first support member 31 so as to pivot about the shaft 24A. On the lower side of the feed roller 24, the retard roller 25 is located.

The first support member 31 is at least half as long as the width of the sheet cassette 21, and extends from one side of the sheet cassette 21 to a position close to the center thereof, in the width direction.

On the side of one end portion of the shaft 24A, a rotating member 42, configured to rotate together with two cams for making the first support member 31 and the second support member 32 pivot, is provided.

Figure 4:
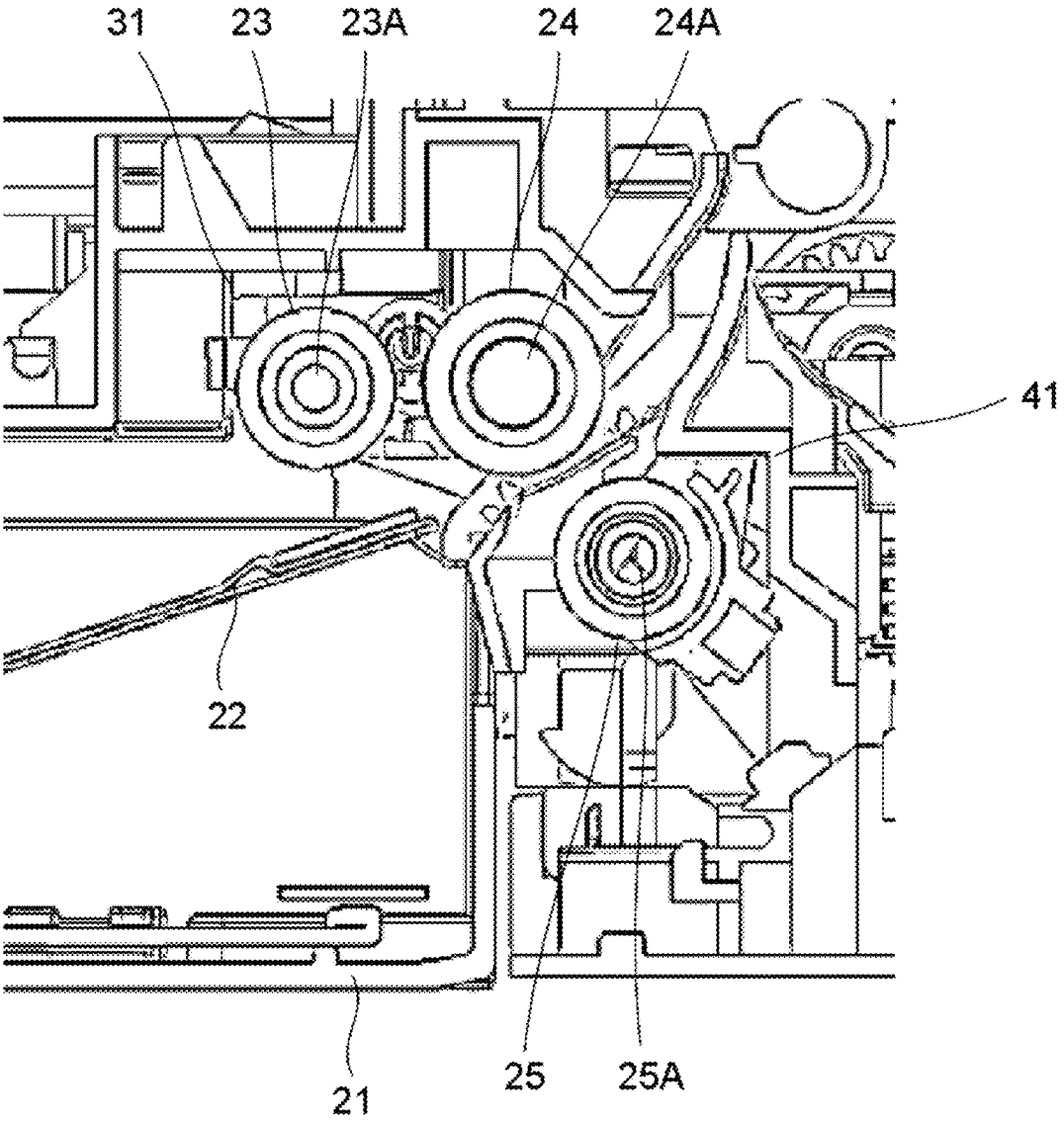
FIG. 4 is a cross-sectional view showing a state where the pickup roller is spaced from an uppermost one of recording sheets on a sheet feeding tray, and the retard roller is spaced from the feed roller.
Figure 5A:
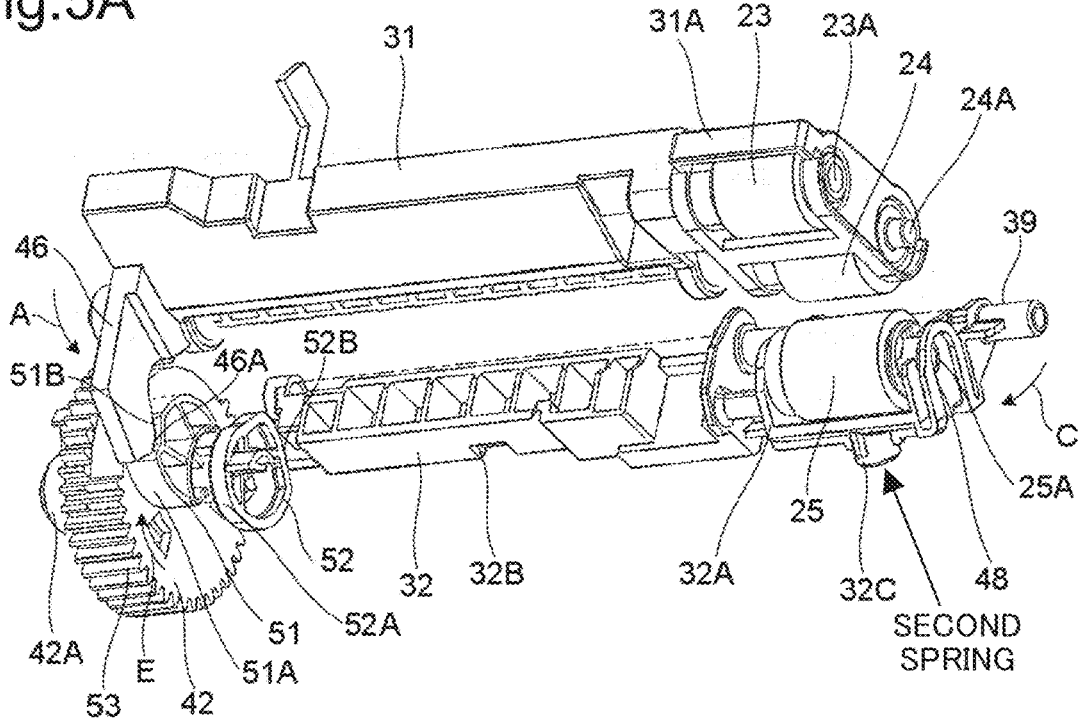
FIG. 5A and FIG. 5B are perspective views, seen from the side of the sheet cassette and from the opposite side, respectively, and showing the pickup roller, the feed roller, a first support member, the retard roller, a second support member, and a rotating member, set in the positions shown in FIG. 4.
Figure 5B:
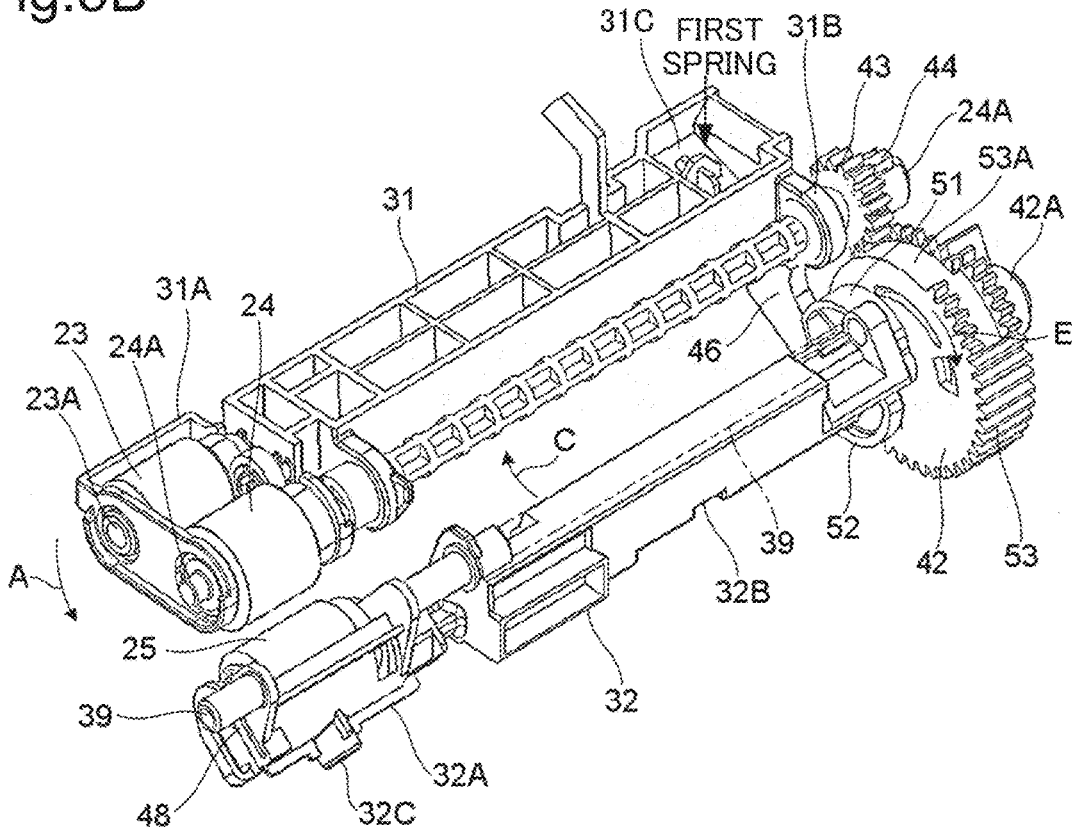

FIG. 4 is a cross-sectional view showing a state where the pickup roller 23 is spaced from the uppermost one of the recording sheets P on the sheet feeding tray 22, and the retard roller 25 is spaced from the feed roller 24. FIG. 5A and FIG. 5B are perspective views, seen from the side of the sheet cassette 21 (not shown in FIG. 5) and from the opposite side, respectively, and showing the pickup roller 23, the feed roller 24, the first support member 31, the retard roller 25, the second support member 32, and the rotating member 42, set in the positions shown in FIG. 4.

As shown in FIG. 4, FIG. 5A, and FIG. 5B, a frame body 31A is provided at one end portion of the first support member 31. The accommodates therein the pickup roller 23 and the feed roller 24, rotatably supports the shaft 23A of the pickup roller 23 and the shaft 24A of the feed roller 24.

As described above, the first support member 31 extends from one side of the sheet cassette 21 to a position close to the center thereof, in the width direction. The shaft 24A of the feed roller 24 is slightly longer than the first support member 31 and protruding through a bearing 31B provided at the other end portion of the first support member 31, and a minor gear 43 is fitted to the end portion of the protruding portion of the shaft 24A. The shaft 24A of the feed roller 24 and the first support member 31 is supported by the frame 41 of the sheet feeding device 20.

A key 44 is provided at the end portion of the shaft 24A protruding from the bearing 31B, and a key groove that fits the key 44 is formed inside the hole of the minor gear 43, so that, because of the key 44 of the shaft 24A being fitted to the key groove of the minor gear 43, a rotational driving force is transmitted from the minor gear 43 to the shaft 24A. The minor gear 43 is movable along the shaft 24A.

The first support member 31 includes a cavity 31C, formed on the upper side of a portion close to the other end portion. In the cavity 31C, a first spring (exemplifying the first biasing member in the disclosure) provided in the frame 41 of the sheet feeding device 20 is inserted in a compressed state. The first spring is biasing the first support member 31 in the direction of arrow A, about the shaft 24A.

The first support member 31 also includes a first follower 46, protruding downward from the bottom of the other end portion. When the first support member 31 is biased by the first spring about the shaft 24A in the direction of arrow A as described above, the first support member 31 and the pickup roller 23 are made to pivot about the shaft 24A. Accordingly, a circumferential surface 46A of the first follower 46 is abutted against a circumferential surface 51A of a first cam 51, one of the two cams provided on the rotating member 42, so that the pivotal motion of the first support member 31 and the pickup roller 23 is delimited.

The second support member 32 extends, like the first support member 31, from one side of the sheet cassette 21 to a position close to the center thereof, in the width direction.

The second support member 32 includes a frame body 32A provided on one end portion, to accommodate therein the retard roller 25 and rotatably support the shaft 25A of the retard roller 25.

The second support member 32 is pivotably supported by the shaft 39, spaced from the shaft 25A of the retard roller 25. The shaft 39 of the second support member 32 is supported by the frame 41 of the sheet feeding device 20.

In addition, the frame body 32A includes a guide groove 48, configured not only to rotatably support the shaft 25A of the retard roller 25, but also to support the shaft 25A so as to move toward and away from the feed roller 24, within a prespecified motion range. The frame body 32A includes a cavity 32C, formed on the bottom side. In the cavity 32C, a second spring (exemplifying the second biasing member in the disclosure) provided in the frame 41 of the sheet feeding device 20 is inserted in a compressed state. The second spring is biasing the shaft 25A of the retard roller 25 in the direction toward the feed roller 24 from the frame body 32A, and at the same time biasing the second support member 32 in the direction of arrow C, about the shaft 39.

The second support member 32 includes a second follower 47 (see FIG. 8), located on the other end portion. When the first support member 32 is biased by the second spring in the direction of arrow C about the shaft 39 as described above, the second support member 32 and the retard roller 25 are made to pivot about the shaft 39, so that a circumferential surface 47A of the second follower 47 is abutted against a second cam 52, the other of the two cams provided on the rotating member 42. Thus, the pivotal motion of the second support member 32 and the retard roller 25 is delimited.

The rotating member 42 is located on the outer side of the other end portion of the first support member 31 and the second support member 32, and rotatably supported. The rotating member 42 includes a major gear 53 formed on the outer circumferential surface. The major gear 53 includes a toothless region 53A, formed on the inner side of a part of the major gear 53.

To the minor gear 43, a rotational driving force of a non-illustrated drive motor (exemplifying the drive device in the disclosure) is transmitted, so that the minor gear 43 and the shaft 24A are driven to rotate. When the minor gear 43 is meshed with the teeth in the outer region of the major gear 53, the shaft 24A is driven to rotate, and when the minor gear 43 fitted to the shaft 24A is made to rotate, the rotation of the minor gear 43 is transmitted to the major gear 53. Accordingly, the major gear 53 and the rotating member 42 rotate in the direction of arrow E, the first cam 51 and the second cam 52 also rotate, the feed roller 24 rotates with the shaft 24A, and also the pickup roller 23 rotates.

When the minor gear 43 reaches the toothless region 53A on the inner side of the major gear 53, because of the rotation of the major gear 53 and the rotating member 42, and then enters the toothless region 53A, the rotation of the minor gear 43 is no longer transmitted to the major gear 53, and therefore the major gear 53 and the rotating member 42 stop rotating, and the first cam 51 and the second cam 52 also stop rotating. However, the shaft 24A keeps rotating interlocked with the minor gear 43, and the feed roller 24 and the pickup roller 23 keep rotating.

Figure 6:
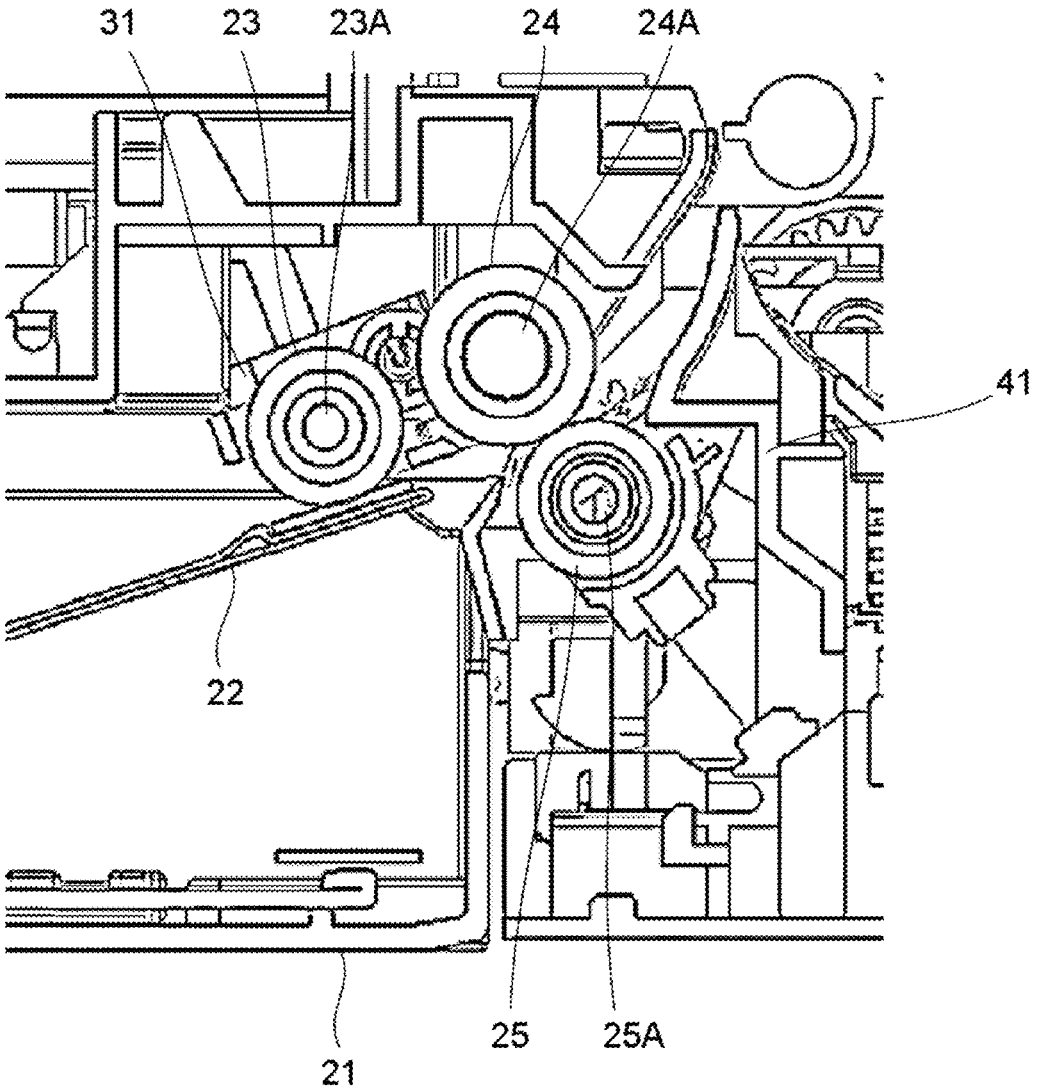
FIG. 6 is a cross-sectional view showing a state where the pickup roller is in pressure-contact with the uppermost one of the recording sheets on the sheet feeding tray, and the retard roller is pressed against the feed roller.
Figure 7A:
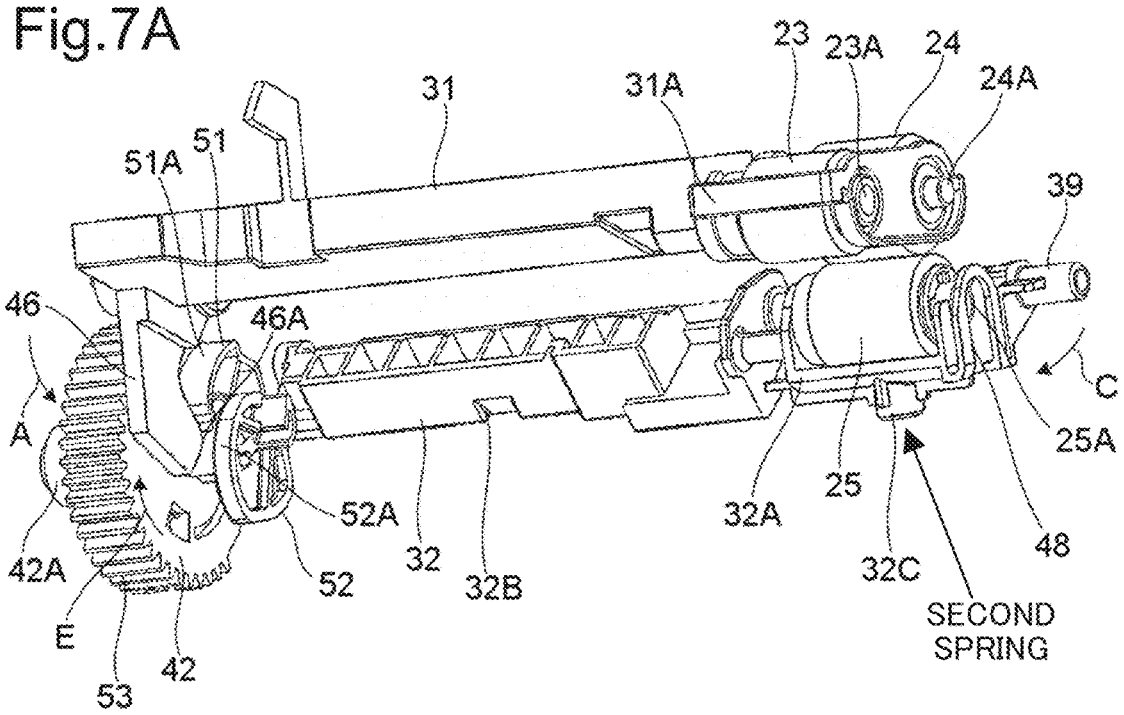
FIG. 7A and FIG. 7B are perspective views, seen from the side of the sheet cassette and from the opposite side, respectively, and showing the pickup roller, the feed roller, the first support member, the retard roller, the second support member, and the rotating member, set in the positions shown in FIG. 6.
Figure 7B:
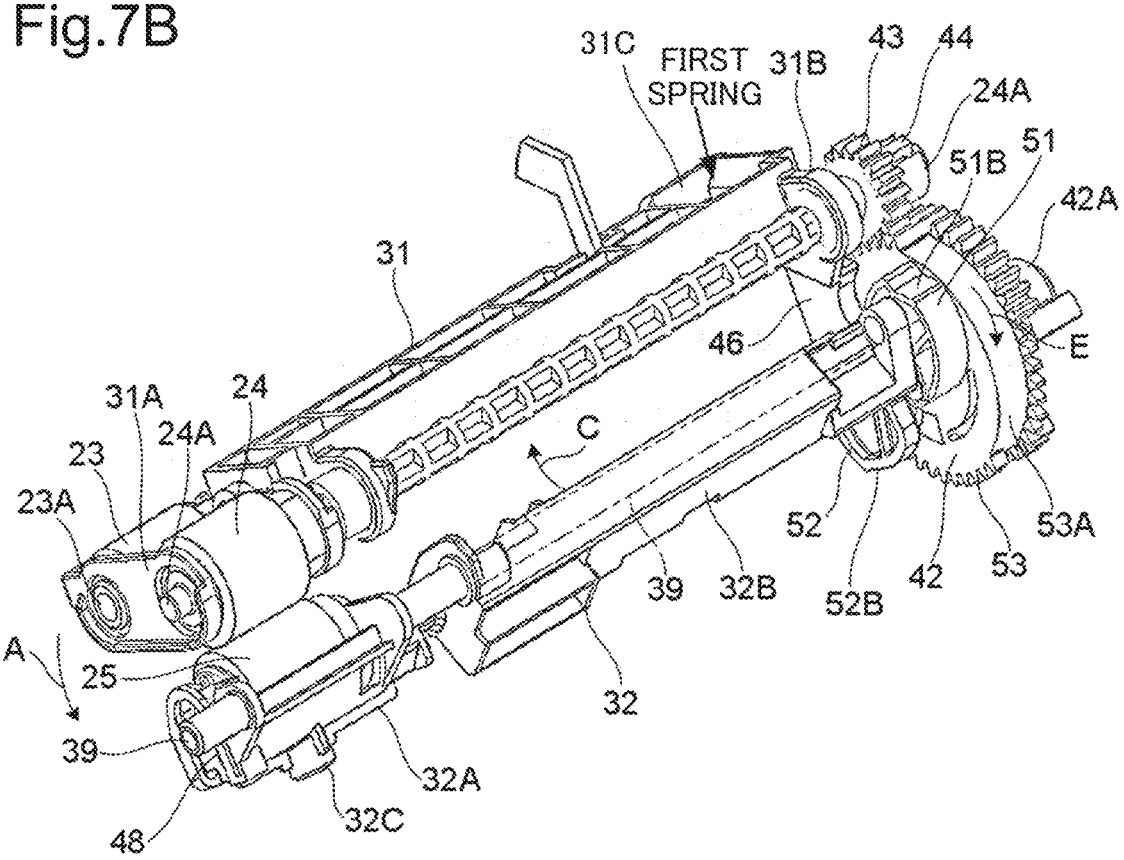

FIG. 6 is a cross-sectional view showing a state where the pickup roller 23 is in pressure-contact with the uppermost one of the recording sheets P on the sheet feeding tray 22, and the retard roller 25 is pressed against the feed roller 24. FIG. 7A and FIG. 7B are perspective views, seen from the side of the sheet cassette 21 (not shown in FIG. 7) and from the opposite side, respectively, and showing the pickup roller 23, the feed roller 24, the first support member 31, the retard roller 25, the second support member 32, and the rotating member 42, set in the positions shown in FIG. 6.

As shown in FIG. 6, FIG. 7A, and FIG. 7B, when the major gear 53 and the rotating member 42 rotate in the direction of arrow E, and the first cam 51 and the second cam 52 also rotate in the direction of arrow E, the circumferential surface 46A of the first follower 46 on the first support member 31 moves so as to follow the circumferential surface 51A of the first cam 51 on the rotating member 42, since the first support member 31 is biased by the first spring in the direction of arrow A about the shaft 24A. Accordingly, the first support member 31 and the pickup roller 23 are made to pivot about the shaft 24A, and the pickup roller 23 is brought into pressure-contact with the uppermost one of the recording sheets P on the sheet feeding tray 22.

In addition, since the second support member 32 is biased by the second spring in the direction of arrow C about the shaft 39, the circumferential surface 47A of the second follower 47 on the second support member 32 moves so as to follow the circumferential surface 52A of the second cam 52 on the rotating member 42. Accordingly, the second support member 32 and the retard roller 25 are made to pivot about the shaft 39, and the retard roller 25 moves toward the feed roller 24. The second follower 47 and the second cam 52 delimit the pivotal motion range of the second support member 32 in the direction of arrow C. The second spring biases the shaft 25A of the retard roller 25 toward the feed roller 24, so as to move the retard roller 25 along the guide groove 48. As result, the retard roller 25 is pressed against the feed roller 24.

Figure 8:
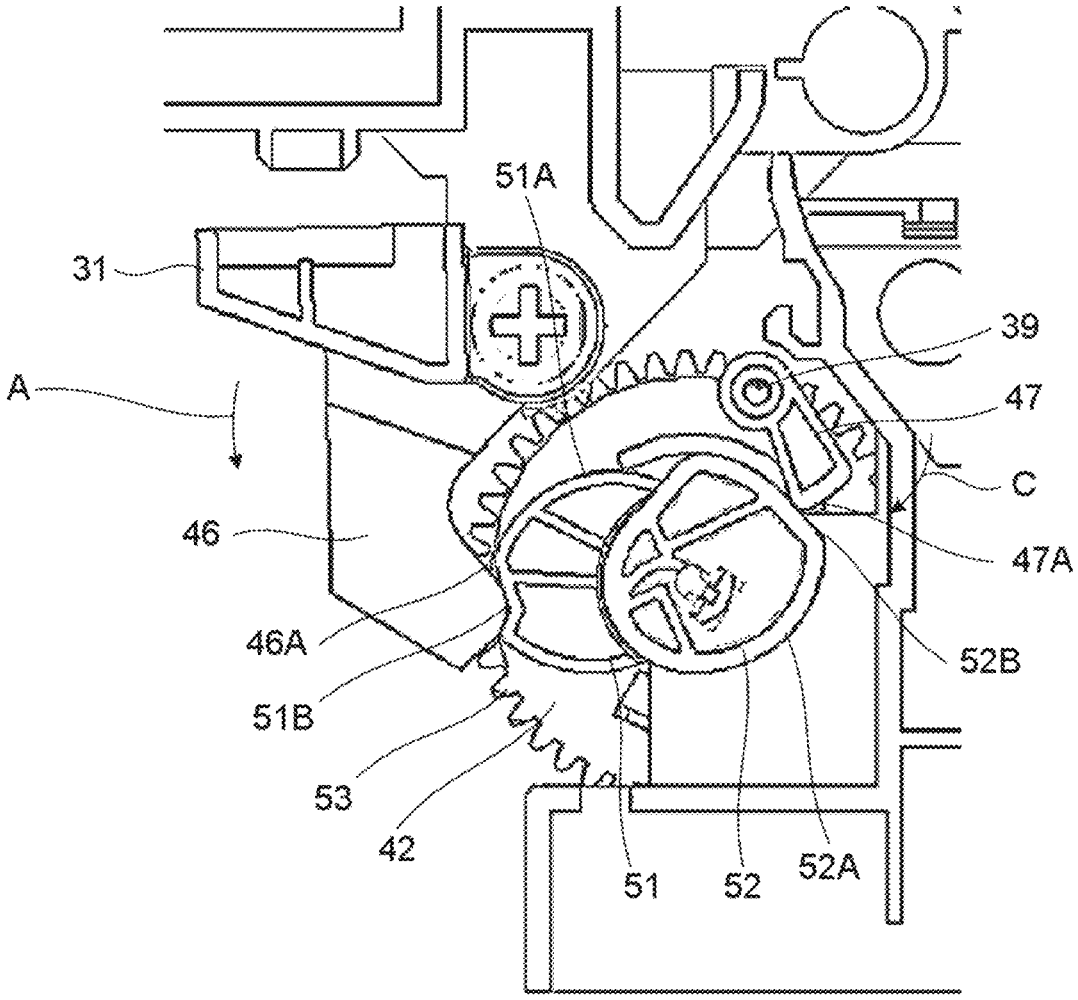
FIG. 8 is a side view showing the rotating member, a first follower, a second follower, a first cam, and a second cam, set in the positions shown in FIG. 4.

FIG. 8 is a side view showing the rotating member 42, the first follower 46, the second follower 47, the first cam 51, and the second cam 52, in the state where, as shown in FIG. 4 and FIGS. 5A and 5B, the pickup roller 23 is spaced from the uppermost one of the recording sheets P on the sheet feeding tray 22, and the retard roller 25 is spaced from the feed roller 24. As shown in FIG. 8, the first cam 51 and the second cam 52 are stacked on the rotating member 42 and integrally supported thereby, such that the rotation center of the rotating member 42, the rotation center of the first cam 51, the rotation center of the second cam 52 coincide with one another.

When the rotating member 42 is set to a prespecified rotation angle as shown in FIG. 8, the first support member 31 is biased by the first spring in the direction of arrow A about the shaft 24A, so that the circumferential surface 46A of the first follower 46 on the first support member 31 is brought into contact with a concave portion 51B in the circumferential surface 51A of the first cam 51. At the same time, the second support member 32 is biased by the second spring in the direction of arrow C about the shaft 39, so that the circumferential surface 47A of the second follower 47 on the second support member 32 is brought into contact with a concave portion 52B in the circumferential surface 52A of the second cam 52.

When the circumferential surface 46A of the first follower 46 on the first support member 31 is in contact with the concave portion 51B of the first cam 51, the circumferential surface 46A of the first follower 46 can hardly be disengaged from the concave portion 51B of the first cam 51. Therefore, the first support member 31 and the pickup roller 23 can be stably retained in the standby position, where the pickup roller 23 on the first support member 31 is spaced from the uppermost one of the recording sheets P on the sheet feeding tray 22.

Likewise, when the circumferential surface 47A of the second follower 47 on the second support member 32 is in contact with the concave portion 52B of the second cam 52, the circumferential surface 47A of the second follower 47 can hardly be disengaged from the concave portion 52B of the second cam 52. Therefore, the second support member 32 and the retard roller 25 can be stably retained in the standby position, where the retard roller 25 on the second support member 32 is spaced from the feed roller 24.

Figure 9:
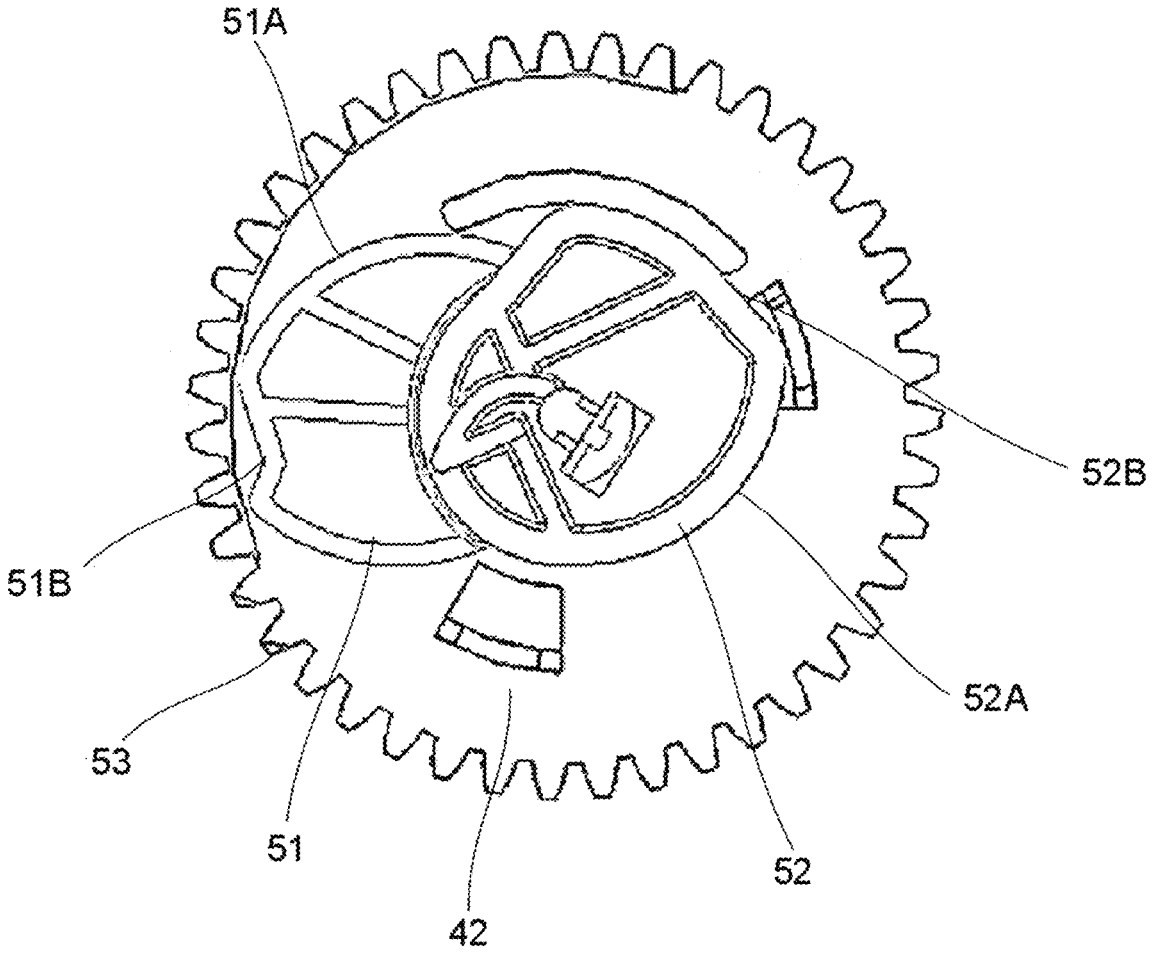
FIG. 9 is a plan view showing the rotating member, the first cam, and the second cam.
Figure 10A:
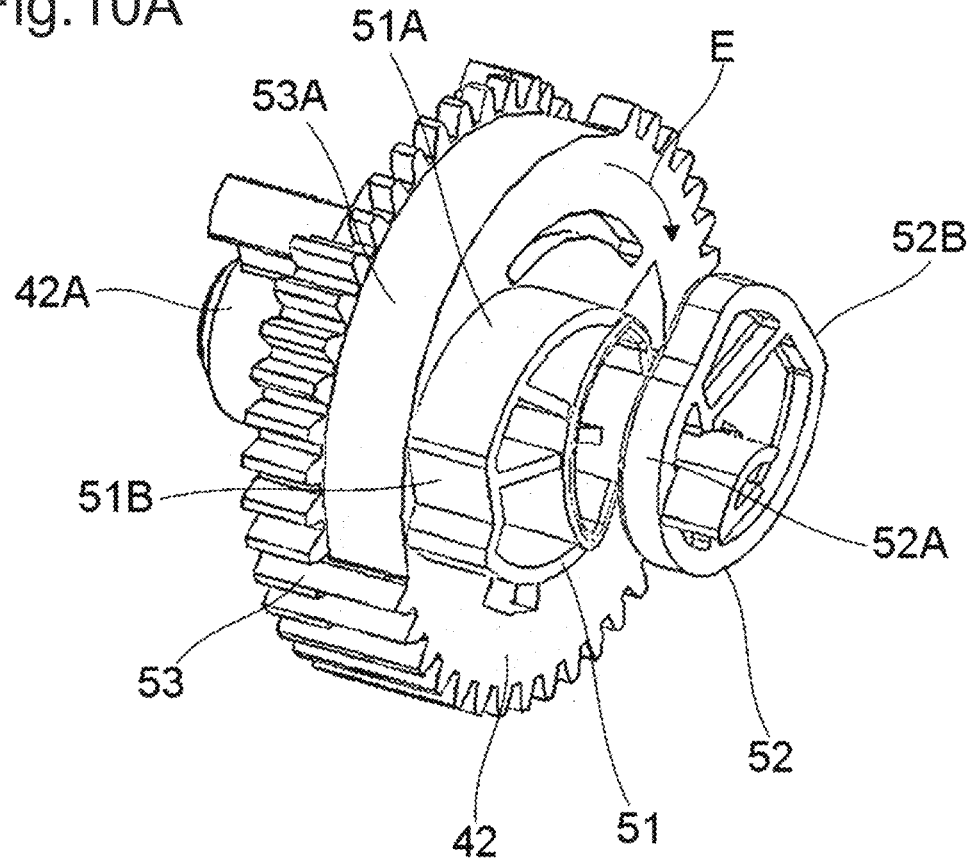
FIG. 10A is a perspective view showing the rotating member, the first cam, and the second cam.
Figure 10B:
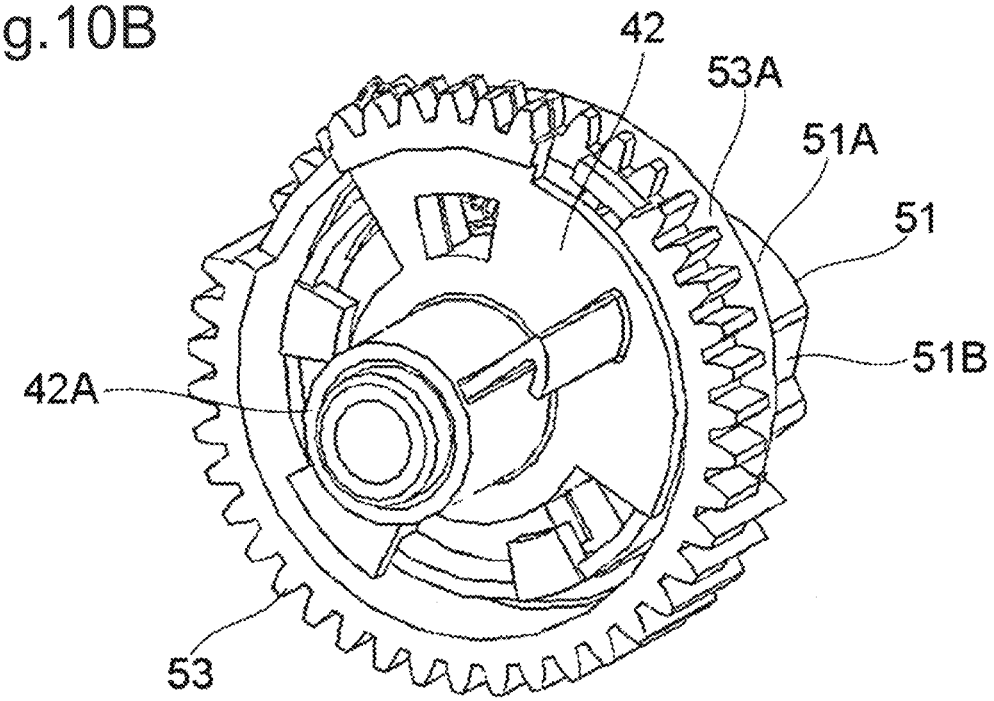
FIG. 10B is a perspective view showing a back face of the rotating member, on which the first cam and the second cam are not provided.

FIG. 9 is a plan view showing the rotating member 42, the first cam 51, and the second cam 52. FIG. 10A is a perspective view showing the rotating member 42, the first cam 51, and the second cam 52. FIG. 10B is a perspective view showing the back face of the rotating member 42, on which the first cam 51 and the second cam 52 are not provided.

As shown in FIG. 9, FIG. 10A, and FIG. 10B, a shaft 42A, provided at the center of the rotating member 42, is rotatably supported by the frame 41 of the sheet feeding device 20. In addition, the major gear 53 is formed on the outer circumferential surface of the rotating member 42, and the toothless region 53A is provided on the inner side of a part of the major gear 53.

As described above, the minor gear 43 is supported so as to move along the shaft 24A, and made to move by a non-illustrated mechanism, along the shaft 24A. When the shaft 24A of the first support member 31 is driven to rotate, with the minor gear 43 moved to the outer region of the major gear 53 and meshed therewith, the minor gear 43 fitted to the shaft 24A is made to rotate, and the rotation of the minor gear 43 is transmitted to the major gear 53, so that the major gear 53, the rotating member 42, the first cam 51, and the second cam 52 are made to rotate in the direction of arrow E.

When the major gear 53 rotates in the direction of arrow E and the minor gear 43 reaches the toothless region 53A on the inner side of the major gear 53, and then enters the toothless region 53A, the minor gear 43 is no longer meshed with the major gear 53, and therefore the rotation of the minor gear 43 is no longer transmitted to the major gear 53. Accordingly, the major gear 53, the rotating member 42, the first cam 51, and the second cam 52 stop rotating, while the shaft 24A keeps rotating interlocked with the minor gear 43, and the feed roller 24 and the pickup roller 23 keep rotating.

When the minor gear 43 is again moved to the outer region of the major gear 53, thus to be meshed therewith, the rotation of the minor gear 43 is transmitted to the major gear 53, so that the major gear 53, the rotating member 42, the first cam 51, and the second cam 52 again start rotating in the direction of arrow E.

Figure 11A:
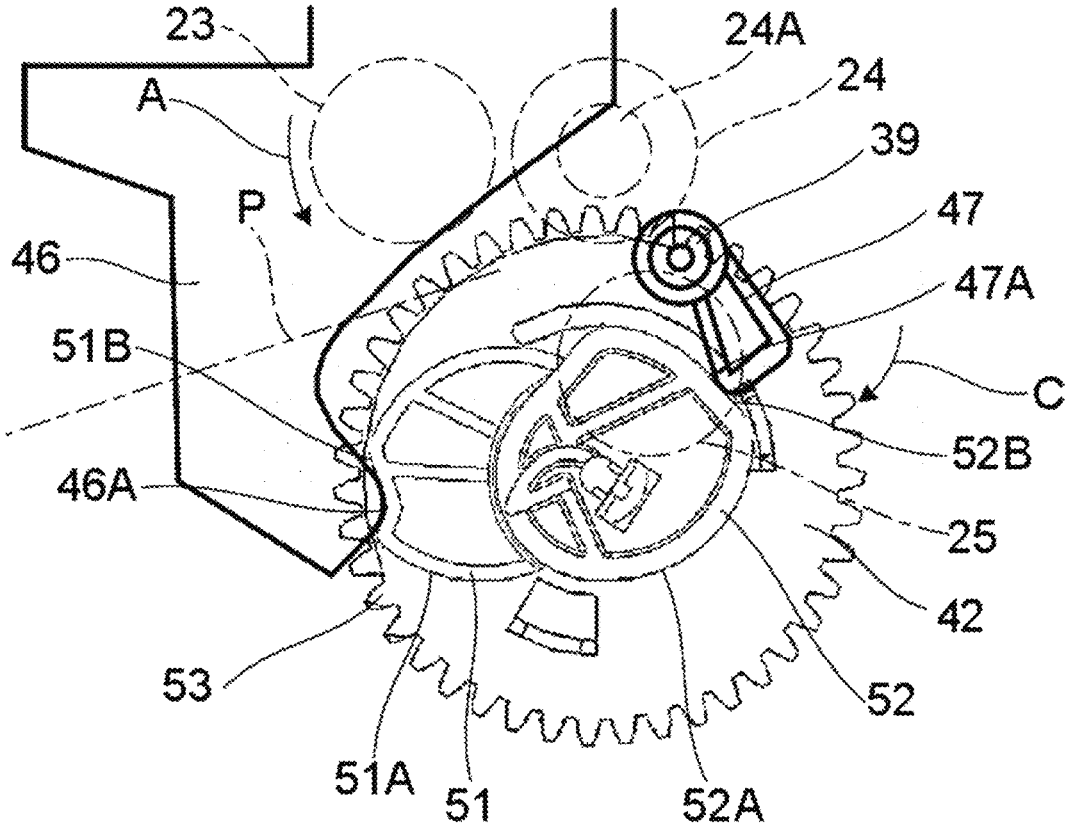
FIG. 11A is a schematic drawing for explaining the working of the pickup roller, the feed roller, the retard roller, and the rotating member.
Figure 11B:
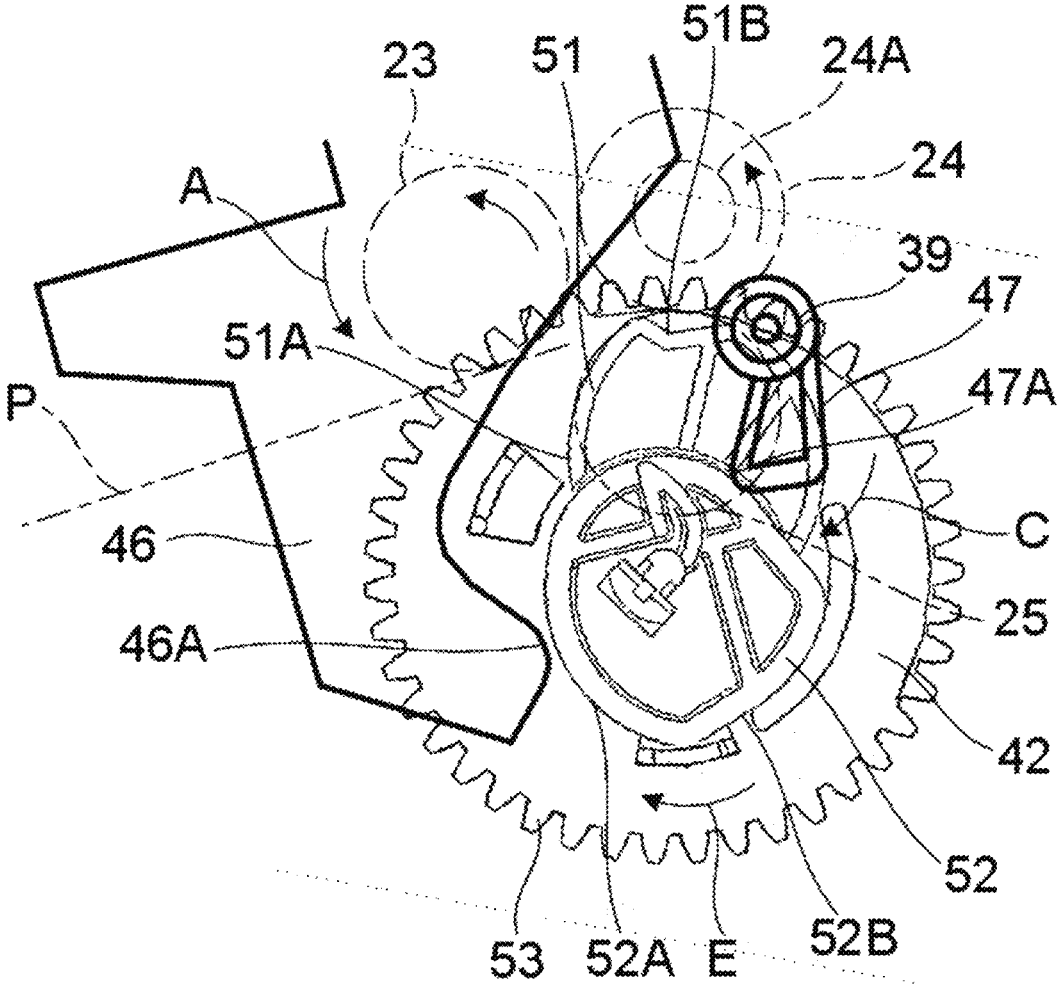
FIG. 11B is another schematic drawing for explaining the working of the pickup roller, the feed roller, the retard roller, and the rotating member.
Figure 11C:
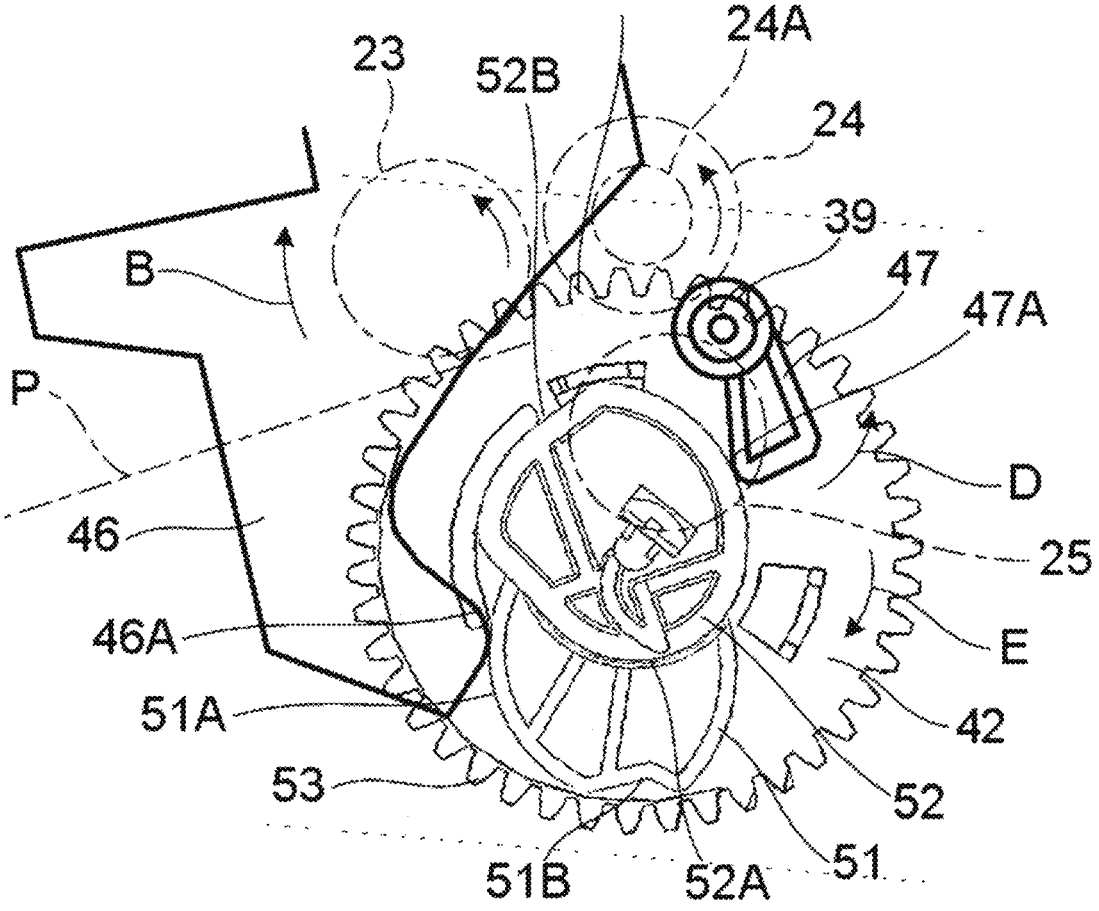
FIG. 11C is another schematic drawing for explaining the working of the pickup roller, the feed roller, the retard roller, and the rotating member.

FIG. 11A to FIG. 11C are schematic drawings for explaining the working of the pickup roller 23, the feed roller 24, the retard roller 25, and the rotating member 42.

When the rotating member 42 is set to a prespecified rotation angle as shown in FIG. 11A, the first support member 31 is biased by the first spring in the direction of arrow A about the shaft 24A, and the circumferential surface 46A of the first follower 46 on the first support member 31 is brought into contact with the concave portion 51B in the circumferential surface 51A of the first cam 51. Therefore, the first support member 31 and the pickup roller 23 can be stably retained in the standby position, where the pickup roller 23 on the first support member 31 is spaced from the uppermost one of the recording sheets P on the sheet feeding tray 22.

Likewise, the second support member 32 is biased by the second spring in the direction of arrow C about the shaft 39, and the circumferential surface 47A of the second follower 47 on the second support member 32 is brought into contact with the concave portion 52B in the circumferential surface 52A of the second cam 52. Therefore, the second support member 32 and the retard roller 25 can be stably retained in the standby position, where the retard roller 25 on the second support member 32 is spaced from the feed roller 24.

When the minor gear 43 is moved, in the mentioned state, to the toothless region 53A on the inner side of the major gear 53, the minor gear 43 is no longer meshed with the major gear 53, and therefore the rotation of the minor gear 43 is no longer transmitted to the major gear 53. Accordingly, the major gear 53, the rotating member 42, the first cam 51, and the second cam 52 stop rotating, while the shaft 24A keeps rotating interlocked with the minor gear 43, and the feed roller 24 and the pickup roller 23 keep rotating.

As described above, when the minor gear 43 is moved to the outer region of the major gear 53, the shaft 24A of the first support member 31 is driven to rotate, and the minor gear 43 fitted to the shaft 24A is made to rotate. The rotation of the minor gear 43 is transmitted to the major gear 53, so that the major gear 53, the rotating member 42, the first cam 51, and the second cam 52 are made to rotate in the direction of arrow E.

When the first cam 51 rotates, and the circumferential surface 46A of the first follower 46 on the first support member 31 is disengaged from the concave portion 51B in the first cam 51, as shown in FIG. 11B, the first support member 31 and the first follower 46 are made to rotate in the direction of arrow, because the first support member 31 is biased by the first spring in the direction of arrow A about the shaft 24A, and the pickup roller 23 is brought into pressure-contact with the uppermost one of the recording sheets P.

When the second cam 52 rotates at the same time, and the circumferential surface 47A of the second follower 47 on the second support member 32 is disengaged from the concave portion 52B in the second cam 52, the circumferential surface 47A of the second follower 47 slides relative to the circumferential surface 52A of the second cam 52 in contact therewith, because the second support member 32 is biased by the second spring in the direction of arrow C about the shaft 39, and the second support member 32 and the second follower 47 are made to rotate in the direction of arrow C, so that the retard roller 25 is pressed against the feed roller 24.

Then the uppermost one of the recording sheets P is drawn out by the pickup roller 23, and transported through between the feed roller 24 and the retard roller 2, toward the transport route 8 (see FIGS. 2A and 2B).

When the first cam 51 rotates further, as shown in FIG. 11C, the circumferential surface 46A of the first follower 46 on the first support member 31 slides relative to the circumferential surface 51A of the first cam 51, in contact therewith, and the first support member 31 and the first follower 46 are made to rotate in the direction of arrow B, against the biasing force of the first spring, so that the pickup roller 23 on the first support member 31 moves away from the uppermost one of the recording sheets P.

When the second cam 52 rotates further at the same time, the circumferential surface 47A of the second follower 47 on the second support member 32 slides relative to the circumferential surface 52A of the second cam 52, in contact therewith, and the second support member 32 and the second follower 47 are made to rotate in the direction of arrow D against the biasing force of the second spring, so that the retard roller 25 moves away from the feed roller 24.

Then the feed roller 24 keeps rotating, thereby continuing with the transport of the recording sheet P.

When the major gear 53 rotates further in the direction of arrow E, so that the minor gear 43 reaches the toothless region 53A on the inner side of the major gear 53, the first support member 31 is biased by the first spring in the direction of arrow A about the shaft 24A, as shown in FIG. 11A, so that the circumferential surface 46A of the first follower 46 on the first support member 31 is brought into contact with the concave portion 51B in the circumferential surface 51A of the first cam 51, and the second support member 32 is biased by the second spring in the direction of arrow C about the shaft 39, so that the circumferential surface 47A of the second follower 47 on the second support member 32 is brought into contact with the concave portion 52B in the circumferential surface 52A of the second cam 52. At this point, the minor gear 43 is moved into the toothless region 53A on the inner side of the major gear 53, and therefore the minor gear 43 is no longer meshed with the major gear 53, and the rotation of the minor gear 43 is no longer transmitted to the major gear 53. Accordingly, the major gear 53, the rotating member 42, the first cam 51, and the second cam 52 stop rotating, while the shaft 24A keeps rotating interlocked with the minor gear 43, and the feed roller 24 and the pickup roller 23 keep rotating. Thus, the original state is restored.

According to this embodiment, as described thus far, the first cam 51 and the second cam 52 are integrally attached to the rotating member 42, and the first follower 46 makes contact with the concave portion 51B formed in the circumferential surface of the first cam 51, when the rotating member 42 is set to a prespecified rotation angle, so that the first support member 31 and the pickup roller 23 are retained in the standby position. Likewise, the second follower 47 makes contact with the concave portion 52B formed in the circumferential surface of the second cam 52, so that the second support member 32 and the retard roller 25 are retained in the standby position. Further, when the rotating member 42 is made to rotate, the first follower 46 is disengaged from the concave portion 51B of the first cam 51, and the first support member 31 is made to pivot about the shaft 24A by the biasing force of the first spring, so as to bring the pickup roller 23 into contact with the recording sheet P. Likewise, the second follower 47 is disengaged from the concave portion 52B of the second cam 52, and the second support member 32 is made to pivot about the shaft 39 by the biasing force of the second spring, so as to bring the retard roller 25 into contact with the feed roller 24. The mentioned arrangement eliminates the need to independently drive each of the first cam 51 and the second cam 52, thereby contributing to reducing the number of parts and the size of the apparatus.

In the case of the existing sheet feeding devices, each of the pickup roller and the retard roller has to be independently driven so as to rotate or stop rotating, to bring the pickup roller into pressure-contact with the uppermost one of the recording sheets, and to press the retard roller against the feed roller. However, providing a lever, a gear, a cam, and so forth to each of the pickup roller and the retard roller, and assembling a mechanism for moving and stopping those rollers, lead to an increase in number of parts. Besides, a larger space has to be secured to locate various parts, which leads to an increase in size of the apparatus.

The configuration according to the foregoing embodiment, in contrast, enables the pickup roller 23 and the retard roller 25 to be moved or stopped with a simplified structure, thereby contributing to reducing the number of parts and the size of the apparatus.

Further, the configurations and processings described in the foregoing embodiments with reference to FIG. 1 to FIG. 11C are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. A sheet feeding device comprising:

a sheet tray on which a plurality of sheets are placed;

a pickup roller that draws out the sheets from the sheet tray, one by one;

a feed roller that transports the sheet drawn out by the pickup roller;

a first support member supporting the pickup roller, and the feed roller at a position downstream of the pickup roller in a drawn out direction of the sheet, and configured to pivot about a first shaft rotatably supporting the feed roller;

a retard roller to be made to contact or moved away from the feed roller;

a second support member supporting the retard roller, and configured to pivot about a second shaft spaced from a shaft of the retard roller;

a drive device that rotates the first shaft of the feed roller;

a rotating member to be made to rotate about a shaft parallel to the first shaft, by a rotational driving force transmitted from the first shaft;

a first cam and a second cam provided on the rotating member, and configured to rotate interlocked with the rotating member;

a first follower provided on the first support member, and configured to make the first support member pivot about the first shaft, by making slide-contact with a circumferential surface of the first cam; and a second follower provided on the second support member, and configured to make the second support member pivot about the second shaft, by making slide-contact with a circumferential surface of the second cam, wherein, when the rotating member is set to a prespecified rotation angle, the first follower makes contact with a concave portion formed in the circumferential surface of the first cam, thereby retaining the first support member at a standby position, and the second follower makes contact with a concave portion formed in the circumferential surface of the second cam, thereby retaining the second support member at a standby position.

2. The sheet feeding device according to claim 1, further comprising:

a first biasing member that biases the first support member so as to pivot about the first shaft, thereby moving the pickup roller toward the sheet on the sheet tray; and a second biasing member that biases the second support member so as to pivot about the second shaft, thereby moving the retard roller toward the feed roller.

3. The sheet feeding device according to claim 1, wherein, when the rotating member rotates from the prespecified rotation angle, and the first follower is disengaged from the concave portion of the first cam, the first support member is made to pivot about the first shaft, thereby bringing the pickup roller supported by the first support member into contact with the sheet on the sheet tray, and when the second follower is disengaged from the concave portion of the second cam, the second support member is made to pivot about the second shaft, thereby bringing the retard roller supported by the second support member into contact with the feed roller.

4. The sheet feeding device according to claim 1, wherein the second support member supports the retard roller so as to move toward and away from the feed roller, in a prespecified motion range.

5. An image forming apparatus comprising:

the sheet feeding device according to claim 1; and an image forming device that forms an image, on a recording sheet delivered from the sheet feeding device.

* * * * *